US006672476B2

(12) United States Patent
Cash et al.

(10) Patent No.: US 6,672,476 B2
(45) Date of Patent: Jan. 6, 2004

(54) SHOT SHELL PRIMER DISPENSER

(75) Inventors: Tedd D. Cash, Waunakee, WI (US); David A. Butler, DeForest, WI (US)

(73) Assignee: Cash Manufacturing Co., Inc., Waunakee, WI (US)

( * ) Notice: Subject to any disclaimer, the term of this patent is extended or adjusted under 35 U.S.C. 154(b) by 130 days.

(21) Appl. No.: 09/736,592

(22) Filed: Dec. 13, 2000

(65) Prior Publication Data

US 2002/0070229 A1 Jun. 13, 2002

(51) Int. Cl.[7] ..... A47F 1/04; G07F 11/16; B65G 59/00; F41C 7/00; F41A 29/00

(52) U.S. Cl. ..... 221/311; 221/309; 221/312 B; 221/292; 221/290; 221/287; 221/312 C; 42/51; 42/84; 42/101; 42/90; 211/70.6

(58) Field of Search ..... 221/307, 311, 221/312 B, 312 C, 312 R, 292, 290, 287, 309; 42/51, 84, 101, 90; 286/718; 211/70.6; 86/33, 34

(56) References Cited

U.S. PATENT DOCUMENTS

| | | | | | |
|---|---|---|---|---|---|
| 35,524 | A | * | 6/1862 | Jones | 221/307 |
| 912,643 | A | | 2/1909 | Bengtson | |
| 1,302,518 | A | | 5/1919 | Dawson et al. | |
| 1,596,951 | A | * | 2/1926 | Smith | 206/378 |
| 2,122,003 | A | * | 6/1938 | Cooper | 221/307 |
| 3,283,425 | A | | 11/1966 | Boyd | |
| 3,283,954 | A | | 11/1966 | Spooner | |
| 3,992,796 | A | * | 11/1976 | Dorgnon | 42/90 |
| 4,172,523 | A | | 10/1979 | Weglage | |
| 4,524,672 | A | | 6/1985 | Balsavage | |
| 4,533,043 | A | * | 8/1985 | Swain | 206/328 |
| 4,550,517 | A | * | 11/1985 | Mansfield | 39/4 |
| 4,685,562 | A | * | 8/1987 | Swain | 206/328 |
| 4,836,371 | A | * | 6/1989 | Long et al. | 206/334 |
| 4,899,876 | A | * | 2/1990 | Murphy et al. | 206/334 |
| 4,940,163 | A | | 7/1990 | Baillet et al. | |
| 5,179,243 | A | | 1/1993 | Schroeder | |
| 5,228,570 | A | * | 7/1993 | Robinson | 206/378 |
| 5,242,051 | A | * | 9/1993 | Murphy | 206/328 |
| 5,509,574 | A | * | 4/1996 | Lenz et al. | 221/197 |
| 5,586,687 | A | | 12/1996 | Spamer et al. | |
| 5,651,464 | A | * | 7/1997 | Weber | 206/718 |
| 5,702,005 | A | * | 12/1997 | Pakersisamy et al. | 206/718 |
| 5,715,951 | A | * | 2/1998 | Dembicks | 211/70.6 |
| 5,797,177 | A | * | 8/1998 | Simmons et al. | 29/739 |
| 5,950,864 | A | | 9/1999 | Cash et al. | |
| 5,975,350 | A | * | 11/1999 | Han | 221/232 |
| 5,987,799 | A | * | 11/1999 | Dedeaux et al. | 42/90 |
| 6,003,726 | A | * | 12/1999 | Hawkes | 221/310 |
| 6,168,018 | B1 | * | 1/2001 | Ramsey et al. | 206/378 |
| 6,237,747 | B1 | * | 5/2001 | Gantner et al. | 198/747 |
| 6,314,670 | B1 | * | 11/2001 | Rodney, Jr. | 42/51 |

* cited by examiner

*Primary Examiner*—Donald P. Walsh
*Assistant Examiner*—Michael E Butler
(74) *Attorney, Agent, or Firm*—Lathrop & Clark LLP

(57) ABSTRACT

A housing has two side walls extend upwardly from a floor to define a channel extending between a primer inlet and a primer outlet. A lanyard clip is fastened to the side walls adjacent the primer inlet, compressing the clip releases it, allowing primers to be loaded through the primer inlet. A spring is riveted to the housing floor with a protruding spacer segment facing the primer inlet, and a restraint segment facing the outlet. Multiple primers are restrained between the spring spacer segment and the primer inlet, yet the spacer segment may be deflected by pushing a primer toward the primer outlet until it is positioned on the restraint segment, and presented for engagement on the primer holder of an in-line action muzzleloading rifle. Pulling the dispenser displaces the primer to move along and depress the restraint segment, and dispensing it. A floor cut-out acts as a decapper.

20 Claims, 2 Drawing Sheets

SHOT SHELL PRIMER DISPENSER

CROSS REFERENCES TO RELATED APPLICATIONS

Not applicable

STATEMENT AS TO RIGHTS TO INVENTIONS MADE UNDER FEDERALLY SPONSORED RESEARCH AND DEVELOPMENT Not applicable.

BACKGROUND OF THE INVENTION

The present invention relates to accessories for muzzle-loading weapons in general, and to dispensers for caps and primers in particular.

Despite their obsolescence as military arms, black powder and muzzleloading weapons continue to see use as sporting arms, both in target and hunting applications. Far from being an abandoned technology, state regulations regarding the use of firearms in hunting have led to an increased interest in muzzleloading weapons, with many states setting aside extended or specialized hunting seasons for hunters using these weapons.

One type of black powder musket which last saw U.S. military use in the Civil War, employed a flanged-cup like cap known as a "top hat" cap. Civil War era soldiers typically carried these brass caps in a paper wrapper, and then in a box or bag, typically of leather, immediately before going into battle. Prior to firing the musket, the concave cap was removed from the bag and placed over the musket's nipple, preparatory to being struck by the hammer to ignite the black powder charge. Another capper for top hat caps has a generally teardrop shaped can, which the user must shake to force a single cap forward for application to the musket nipple. In U.S. Pat. No. 5,950,864 issued Sep. 14, 1999 (the disclosure of which is incorporated by reference herein), a top hat capper was disclosed which accommodated multiple inline top hat caps for convenient dispensing.

True top hat caps are used by shooters who place a high value on fidelity to historical technology. Nevertheless, these specialized caps are not available in all sporting goods stores, and as a result may need to be ordered through the mail. Developments in postal regulations can make the shipment of munitions a burdensome operation. Hence, many muzzleloaders have sought a modern alternative to the traditional top hat musket cap. This need has been supplied by the substitution of conventional 209 shotgun primers. These shotgun primers are readily available, as they are widely used for reloading shotgun shells. In the last decade, in-line action muzzleloading rifles have been developed which utilize shotgun primers. These firearms have a rifled barrel, and a primer holder or primer nip which receives the shotgun primer and holds it in position with respect to the barrel. The chamber rearward of the primer holder is in-line with the barrel, and is thus a fairly tight space, which will not admit a top hat capper such as the one disclosed in U.S. Pat. No. 5,950,864. Molded plastic cappers, which hold only a single primer at one time are known, but these devices require a new primer to be loaded after each dispensing, impeding the speed with which a shooter can make subsequent shots.

What is needed is a dispenser for multiple shotgun primers which may be employed with inline action muzzle-loaders.

SUMMARY OF THE INVENTION

The primer dispenser of this invention has a brass housing with an axially extending floor with two converging upwardly extending side walls which define a channel extending between a primer inlet and a primer outlet. A resilient lanyard clip is removably fastened to the side walls adjacent the primer inlet. By compressing the clip, pins on the end of the clip legs are released from pin holes in the side walls, allowing the clip to be removed and primers to be loaded through the primer inlet. At the opposite end, a spring steel spring is riveted to the housing floor. The spring has a protruding spacer segment facing the primer inlet, and a restraint segment facing the outlet. A series of primers are restrained between the spring spacer segment and the primer inlet, yet the spacer segment may be deflected by pushing a primer toward the primer outlet until it is engaged on the restraint segment. The engaged primer is then presented for engagement on the primer holder of an in-line action muzzleloading rifle. By pulling the dispenser, the primer is moved along the restraint segment, depressing it, and allowing the primer to be dispensed. A semicircular cut-out in the floor adjacent the primer outlet serves as a decapper, allowing the spent primer to be removed.

It is an object of the present invention to provide a dispenser for shotgun primers into the primer holder of an in-line action muzzleloading rifle.

It is a further object of the present invention to provide a dispenser for shotgun primers into the primer holder of an in-line action muzzleloading rifle, which holds multiple primers for hand advancement.

It is another object of the present invention to provide a dispenser for shotgun primers which also functions as a decapper.

It is an additional object of the present invention to provide a capper for dispensing shotgun primers which is economically fabricated of metal.

Further objects, features and advantages of the invention will be apparent from the following detailed description when taken in conjunction with the accompanying drawings.

DESCRIPTION OF THE PREFERRED EMBODIMENTS

Figure 1:
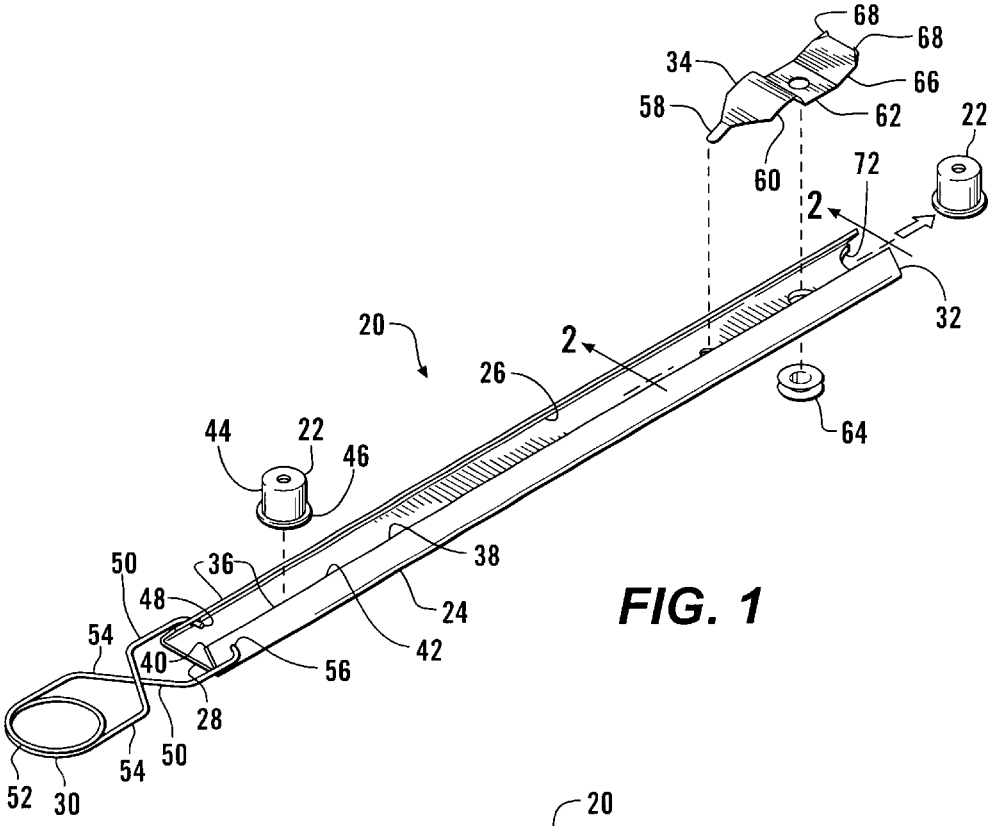
FIG. 1 is an exploded isometric view of the primer dispenser of this invention.

Referring more particularly to FIGS. 1–4, wherein like numbers refer to similar parts, a dispenser 20 for 209 shotgun primers 22 is shown in the figures. The dispenser 20 has a brass housing 24 which may be formed of bent sheet stock. The sheet stock may be about 1/32 inch thick. The housing has an axially extending floor 26 which extends from a primer inlet 28 which is releasably blocked by a lanyard clip 30 to a primer outlet 32 which is releasably blocked by a spring 34. Two side walls 36 extend upwardly and inwardly from the floor 26, at an angle of about 45 degrees. A channel 38 is defined between the side walls 36 that extends from the primer inlet 28 to the primer outlet 32. A central slot 42 is defined between the two edges 40 of the side walls 36 which is about one quarter inch wide, a dimension which is just slightly larger than the diameter of a primer 22.

Figure 3:
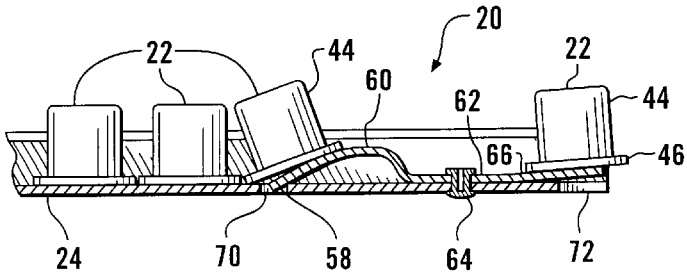
FIG. 3 is a cross-sectional view of the dispenser of FIG. 2 showing primers in place.
Figure 4:
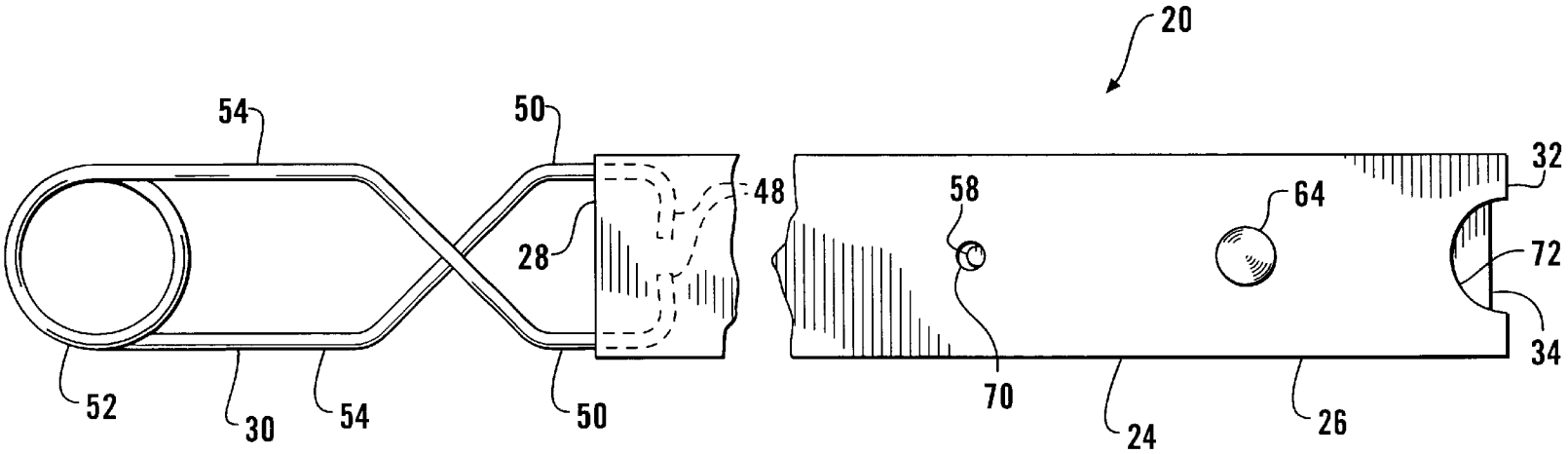
FIG. 4 is a fragmentary bottom plan view of the dispenser of FIG. 1.

The housing 24 is configured to accommodate a sequence of primers 22. For example, a housing 24 which is about 4½ inches long may hold about 13 primers. As shown in FIG. 3, each primer 22 has a cylindrical body 44 with a peripheral flange 46. In order to introduce the primers into the dispenser 20, the user must temporarily remove the clip 30. As shown in FIG. 4, the clip 30 is formed from a bent wire, for example 0.045 inch diameter tempered spring steel. The clip 30 has two opposed pin segments 48 which extend inwardly from crossed legs 50 which are joined at a double loop 52. It should be noted that a single loop, or more than two loops may be employed. The pin segments 48 extend into small openings 56 in the side walls 36 adjacent the primer inlet 28. By pressing on segments 54 of the clip 30 between the legs 50 and the double loop 52, the pin segments 48 are caused to separate, allowing the clip to be separated from the housing 24. Once the clip 30 has been removed, the pin segments 48 no longer block the channel 38, and multiple primers 22 may be inserted into the channel, with the primer flanges 46 adjacent the housing floor 26. Once the channel 38 has been filled with primers 22, the spring clip 30 is replaced. The pin segments, protruding within the channel 38 above the housing floor 26 restrict the escape of the primers through the primer inlet 28.

Figure 2:
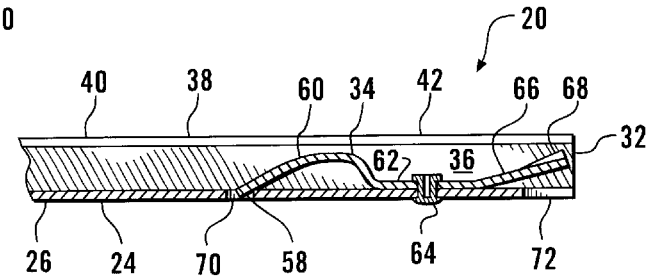
FIG. 2 is a cross-sectional view of the dispenser of FIG. 1 taken along section line 2—2.

The spring 34, shown in FIG. 1, has a narrow tongue 58 which projects downwardly and toward the primer inlet 28 from a convex flexible spacer segment 60. The spacer segment 60 of the spring 34 is joined to a generally flat attachment segment 62 which lies adjacent the housing floor 26 and which is fastened to the housing floor by a rivet 64. A restraint segment 66 extends upwardly from the attachment segment and extends toward the primer outlet 32. The restraint segment 66 is terminated by two bent corner tabs 68 which engage the flange 46 of the cylindrical primer 22. The restraint segment 66, as shown in FIGS. 2 and 3, is resilient, and deflects resiliently when the primer 22 is moved axially toward the primer outlet 32. The primer holder, not shown, will typically have a number of spring loaded tabs arranged to define a cylindrical cavity into which the projecting cylindrical body 44 of the primer may be inserted, while the primer is still fully engaged in the dispenser 20. Prior to being dispensed, the primer 22 is clasped between the restraint segment and the undersides of the inwardly slanted side walls 36, preventing the primer from dropping out of the dispenser. However, once engaged within the primer holder, the dispenser may be pulled away from the primer. This motion of the dispenser 20 will urge the primer across the restraint segment of the spring, depressing it, permitting the primer to pass out the primer outlet 32 at the end of the housing 24, leaving it engaged by the primer holder of the rifle.

As shown in FIG. 2, the spacer segment 60 of the spring 34 projects upwardly from the housing floor and forms a convex resilient band which serves as an obstacle or resilient barrier to the remaining primers, preventing them from passing onto the restraint segment 66. The tongue 58 of the spring 34 extends from the restraint segment 66 into a tongue hole 70 formed in the floor 26 of the housing 24. The engagement of the tongue 58 restricts the pivoting of the spring, while still allowing the spaced segment 60 to flex. Because of the narrow confines of the rifle cavity rearward of the primer holder, the primers, other than the one to be dispensed, should not enter into the cavity. The spacer segment 60 keeps the length of the dispenser which must extend into the rifle cavity clear of primers, except for the one to be dispensed, which can extend into the primer holder of the firearm. A primer is about 5/16 inches tall, while the dispenser itself is less than 3/16 inches tall. The spring may be about 1⅛ inch long, with the restraint segment being about one quarter inch long, and the attachment segment 62 being about one quarter inch long. The spring is about one quarter inch wide.

Once a first primer has been dispensed, the next primer can be readily advanced to a dispensing position by urging the primer axially toward the primer outlet, and over the spacer segment 60. This movement causes the resilient deflection of the spacer segment, allowing the primer to pass over the attachment segment 62 and onto the restraint segment 66.

As best shown in FIG. 4, the floor 26 of the housing 24 has a semi-circular cut-away 72 adjacent the primer outlet 32. This cut-away has a diameter of about one quarter inch, about the same diameter as a primer body 44. After a round has been fired in the rifle, it is necessary to remove the spent primer from the primer holder. The cut-away 72 permits the dispenser 20 to also serve as a primer extractor or decapper. The cut-away 72 is positioned around the spent primer, and the housing is pivoted to pry the primer out of the primer holder. It should be noted that the cut-away could also be located at the primer inlet end of the housing.

It should be noted that other types of clips may be employed to retain the primers within the housing, and to selectably close the primer inlet 28. For example, a bent strip of spring steel may be placed adjacent the primer inlet. In such a case, a separate halyard clip may be employed.

It is understood that the invention is not limited to the particular construction and arrangement of parts herein illustrated and described, but embraces such modified forms thereof as come within the scope of the following claims.

We claim:

1. A dispenser for primers into a muzzleloading firearm, the dispenser comprising:

a housing having an axially extending floor, wherein two side walls extend upwardly from the floor, the side wails extending toward each other, and defining an axially extending channel between the side walls and above the floor, the channel extending between a primer inlet and a primer outlet;

a clip removably fastened to the housing adjacent the primer inlet, the clip having portions which extend inwardly into the channel to block the channel and prevent the escape of primers through the primer inlet; and a unitary spring fastened to the housing floor adjacent the primer outlet, the spring having a flexible spacer segment, an attachment segment, and a restraint segment, the restraint segment extending toward the primer outlet, and the spacer segment extending toward the primer inlet, wherein the spacer segment projects upwardly from the housing floor to a height to prevent the advancement of primers within the channel toward the primer outlet, and wherein the spacer segment is resiliently deflectable by movement of a primer onto the spacer segment to permit a primer to be advanced onto the restraint segment, the restraint segment extending upwardly from the housing floor, and being resiliently deflectable by movement of a primer onto and across the restraint segment, to thereby permit a primer to be dispensed from the primer outlet.

2. The dispenser of claim 1 wherein portions of the housing floor define a semi-circular cut-away which is positionable about a primer within a firearm, such that pivoting of the dispenser dislodges said primer from said firearm.

3. The dispenser of claim 2 wherein the cut-away is positioned adjacent the primer outlet.

4. The dispenser of claim 1 wherein the spring is fixed to the housing floor by a fastener which extends through the attachment segment.

5. The dispenser of claim 1 further comprising:

portions of the housing floor which define a hole positioned rearwardly of the primer outlet; and a tongue which extends from the spring toward the primer inlet and is received within the hole.

6. The dispenser of claim 1 wherein the restraint segment is terminated by two bent corner tabs, positioned to engage the peripheral flange extending from a cylindrical primer.

7. A dispenser for primers into a muzzleloading firearm, the dispenser comprising:

a housing having an axially extending floor, wherein two side walls extend upwardly from the floor, the side walls having portions which extend toward each other, and defining an axially extending channel between the side walls and above the floor, the channel extending between a primer inlet and a primer outlet;

a clip fastened to the housing, the clip being adjustable between a first position which permits access to the primer inlet for the insertion of primers, and a second position which blocks access to the primer inlet to prevent the escape of primers through the primer inlet; and a unitary spring fixed to the housing floor having a spacer segment which projects upwardly from the floor and a restraint segment spaced from the spacer segment toward the primer outlet, the restraint segment extending upwardly from the housing floor, and being resilient to urge a primer supported on the restraint segment upwardly against the side wall inwardly extending portions, wherein the spacer segment blocks the advancement of primers onto the restraint segment, to maintain a space between a primer positioned on the restraint segment, and remaining primers retained within the channel, yet wherein the spacer segment is deflectable to permit a primer to be moved toward the primer outlet and onto the restraint segment, and wherein a primer on the restraint segment may be moved toward the primer outlet for dispensing into the firearm.

8. The dispenser of claim 7 wherein portions of the housing floor define a semi-circular cut-away which is positionable about a primer within a firearm, such that pivoting of the dispenser dislodges said primer from said firearm.

9. The dispenser of claim 8 wherein the cut-away is positioned adjacent the primer outlet.

10. The dispenser of claim 7 wherein the spring has an attachment segment which extends parallel to the floor and which is positioned between the spacer segment and the restraint segment, and wherein the attachment segment is fixed to the housing floor by a fastener which extends through the attachment segment.

11. The dispenser of claim 7 further comprising:

portions of the housing floor which define a hole positioned rearwardly of the primer outlet; and a tongue which extends from the spring toward the primer inlet and is received within the hole.

12. The dispenser of claim 7 wherein the restraint segment is terminated by two bent corner tabs, positioned to engage the peripheral flange extending from a cylindrical primer.

13. A dispenser for primers into a muzzleloading firearm, the dispenser comprising:

a housing having an axially extending floor, wherein two side walls extend upwardly from the floor, the side walls having portions which extend toward each other and are spaced apart to define an upwardly facing opening, and defining an axially extending channel between the side walls and above the floor, the channel extending between a primer inlet and a primer outlet; and a spring fixed to the housing floor, and having a resilient spacer segment which projects upwardly from and is fastened to the floor, and a restraint segment spaced from the spacer segment toward the primer outlet, the restraint segment extending upwardly from and being fastened to the housing floor, and being resilient to urge a primer supported on the restraint segment upwardly against the side wall inwardly extending portions, wherein the spacer segment blocks the advancement of primers onto the restraint segment, to maintain a space between a primer positioned on the restraint segment, and remaining primers retained within the channel, yet wherein the spacer segment is deflectable to permit a primer to be moved toward the primer outlet and onto the restraint segment, and wherein a primer on the restraint segment may be moved toward the primer outlet for dispensing into the firearm.

14. The dispenser of claim 13 wherein portions of the housing floor define a semi-circular cut-away which is positionable about a primer within a firearm, such that pivoting of the dispenser dislodges said primer from said firearm.

15. The dispenser of claim 14 wherein the cut-away is positioned adjacent the primer outlet.

16. The dispenser of claim 15 wherein the spring has an attachment segment which extends parallel to the floor and which is positioned between the spacer segment mid the restraint segment, and wherein the attachment segment is fixed to the housing floor by a fastener which extends through the attachment segment.

17. The dispenser of claim 13 further comprising:

portions of the housing floor which define a hole positioned rearwardly of the primer outlet; and a tongue which extends from the spring toward the primer inlet and is received within the hole.

18. The dispenser of claim 13 wherein the restraint segment is terminated by two bent corner tabs, positioned to engage the peripheral flange extending from a cylindrical primer.

19. A dispenser loaded with a plurality of primers for dispensing into a muzzleloading firearm, the loaded dispenser comprising:

a housing having an axially extending floor, wherein two side walls extend upwardly from the floor, the side walls having portions which extend toward each other, and defining an axially extending channel between the side walls and above the floor, the channel extending between a primer inlet and a primer outlet;

a unitary spring fixed to the housing floor, having a spacer segment which projects upwardly from the floor and a restraint segment spaced from the spacer segment toward the primer outlet, the restraint segment extending upwardly from the housing floor, and being resilient to urge a primer supported on the restraint segment upwardly against the side wall inwardly extending portions;

at first primer positioned within the channel between the side walls and between the primer inlet and the spacer segment, the spacer segment blocking the advancement of the first primer onto the restraint segment until a force is applied to the first primer to advance it over the spacer segment, deflecting it; and a second primer positioned on the restraint segment, the restraint segment resiliently urging the second primer into engagement with portions of the side walls, wherein the second primer is extractable from the channel by being urged toward and through the primer outlet.

20. The dispenser of claim 19 wherein portions of the housing floor define a semi-circular cut-away which is positionable about a primer within a firearm, such that pivoting of the dispenser dislodges said primer from said firearm.

* * * * *

UNITED STATES PATENT AND TRADEMARK OFFICE

CERTIFICATE OF CORRECTION

PATENT NO. : 6,672,476 B2
APPLICATION NO. : 09/736592
DATED : January 6, 2004
INVENTOR(S) : Tedd D. Cash and David A. Butler It is certified that error appears in the above-identified patent and that said Letters Patent is hereby corrected as shown below:

In column 4, line 38 of the issued patent, " wails" should be -- walls -- as written in the amendement dated October 8, 2002 on page 2 line 4.

In column 6, line 37 of the issued patent, " mid" should be -- and -- as written in the application dated December 13, 2000 on page 13 line 2.

Signed and Sealed this

Thirtieth Day of January, 2007

JON W. DUDAS
*Director of the United States Patent and Trademark Office*